US007750928B2

(12) United States Patent
Baek et al.

(10) Patent No.: US 7,750,928 B2
(45) Date of Patent: Jul. 6, 2010

(54) LIGHT SOURCE APPARATUS AND METHOD FOR DRIVING THE SAME

(75) Inventors: Sujin Baek, Geoje-si (KR); Hak Soo Kim, Daegu (KR)

(73) Assignee: LG Display Co., Ltd., Seoul (KR)

( * ) Notice: Subject to any disclaimer, the term of this patent is extended or adjusted under 35 U.S.C. 154(b) by 811 days.

(21) Appl. No.: 11/707,048

(22) Filed: Feb. 16, 2007

(65) Prior Publication Data

US 2008/0043047 A1 Feb. 21, 2008

(30) Foreign Application Priority Data

Aug. 16, 2006 (KR) ..... 10-2006-0077011

(51) Int. Cl.
*G09G 5/10* (2006.01)

(52) U.S. Cl. ..... 345/694; 345/76; 345/82

(58) Field of Classification Search ..... 345/76, 345/82, 102, 694; 313/498, 505; 315/169.3; 359/242; 257/88; 358/520; 382/274
See application file for complete search history.

(56) References Cited

U.S. PATENT DOCUMENTS 7,091,938 B2 * 8/2006 Inukai et al. ..... 345/76

* cited by examiner

*Primary Examiner*—Abbas I Abdulselam
(74) *Attorney, Agent, or Firm*—Morgan Lewis & Bockius LLP

(57) ABSTRACT

A light source apparatus includes a substrate, cell blocks, a scan driver and a data driver. The cell blocks includes a plurality of sub-pixels located in a matrix type format at intersections between a plurality of scan lines and a plurality of data lines on the substrate. The scan driver supplies scan signals to the cell blocks through the scan lines. The data driver supplies data signals to the cell blocks such that a summation of brightness values of the cell blocks per a frame remains constant during a period and at least one cell block among the cell blocks has a different brightness value from that of another cell block among the cell blocks during respective frame. The period is comprised a predetermined number of frame.

16 Claims, 3 Drawing Sheets

Fig. 3

| | 1 frame | 2 frame | 3 frame | 4 frame |
|---|---|---|---|---|
| Block 1 | 50% | 100% | 100% | 70% |
| Block 2 | 70% | 50% | 100% | 100% |
| Block 3 | 100% | 70% | 50% | 100% |
| Block 4 | 100% | 100% | 70% | 50% |

1 period

Fig. 4

| | 1 frame | 2 frame | 3 frame | 4 frame |
|---|---|---|---|---|
| Block 1 | 50% | 70% | 100% | 100% |
| Block 2 | 70% | 100% | 100% | 50% |
| Block 3 | 100% | 100% | 50% | 70% |
| Block 4 | 100% | 50% | 70% | 100% |

1 period

Fig. 5

| | 1 frame | 2 frame | 3 frame | 4 frame |
|---|---|---|---|---|
| Block 1 | 50% | 100% | 100% | 70% |
| Block 2 | 70% | 50% | 100% | 100% |
| Block 3 | 100% | 70% | 50% | 100% |
| Block 4 | 100% | 100% | 70% | 50% |

1 period

| | 1 frame | 2 frame | 3 frame | 4 frame |
|---|---|---|---|---|
| Block 1 | 60% | 100% | 90% | 70% |
| Block 2 | 70% | 60% | 100% | 90% |
| Block 3 | 90% | 70% | 60% | 100% |
| Block 4 | 100% | 90% | 70% | 60% |

2 period

LIGHT SOURCE APPARATUS AND METHOD FOR DRIVING THE SAME

CROSS-REFERENCE

This application claims priority to and the benefit of Korea Patent Application No. 10-2006-0077011, filed on Aug. 16, 2006, the entire content of which is incorporated herein by reference.

BACKGROUND

1. Field

The present invention relates to a light source apparatus and a method of driving the same.

2. Related Art

Organic light emitting display devices are widely used in light source apparatuses such as backlight units or illumination apparatuses. The organic light emitting display device comprises an organic emission layer formed between an anode and a cathode. Thus, holes supplied from an anode and electrons supplied from a cathode are connected together within the organic emission layer to produce excitons, which are electron-hole pairs. When these excitons transit to a ground state, a certain level of energy is produced, and this energy causes the organic light emitting display device to emit light.

The light source apparatuses adopting the organic light emitting display device have reduced power consumption compared with External Electrode Flourscent Lamp (EEFL) or Cold Cathode Flourscent Lamp (CCFL).

The light source apparatus may include an organic light emitting panel or a plurality of electrically connected small organic light emitting panels. All organic light emitting panels are turned on to emit lights when power supply signal is applied to the organic light emitting panels.

However, when the light source apparatus having the organic light emitting panels is continuously driven, the organic light emitting panels may be deteriorated and the lifespan of the light source apparatus may be reduced.

SUMMARY

Accordingly, the present invention is provided to substantially obviate one or more problems due to limitations and disadvantages of the related art.

The present invention is directed to a light source apparatus having enhanced lifespan and enhanced luminous efficiency, and a method of driving the light source apparatus.

The present invention provides a method of driving a light source apparatus including a plurality of cell blocks, comprising: supplying a scan signal to the cell blocks respectively having at least one sub-pixel; and supplying a data signal to the cell blocks such that a summation of brightness values of the cell blocks per a frame remains constant during a period and at least one cell block among the cell blocks has a different brightness value from that of another cell block among the cell blocks during respective frame, wherein the period is comprised a predetermined number of frame.

The present invention also provides A light source apparatus comprising: a substrate; a plurality of cell blocks including a plurality of sub-pixels located in a matrix type format at intersections between a plurality of scan lines and a plurality of data lines on the substrate; a scan driver supplying a plurality of scan signals to the cell blocks through the scan lines; a data driver supplying a plurality of data signals to the cell blocks such that a summation of brightness values of the cell blocks per a frame remains constant during a period and at least one cell block among the cell blocks has a different brightness value from that of another cell block among the cell blocks during respective frame, wherein the period is comprised a predetermined number of frame.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 3 illustrates a schematic diagram showing a method of driving the light source apparatus according to an example embodiment of the present invention;

FIG. 4 illustrates a schematic diagram showing a method of driving the light source apparatus according to another example embodiment of the present invention; and FIG. 5 illustrates a schematic diagram showing a method of driving the light source apparatus according to still another example embodiment of the present invention.

DETAILED DESCRIPTION OF EMBODIMENTS

Reference will now be made in detail to the example embodiments of the present invention, examples of which are illustrated in the accompanying drawings.

Figure 1:
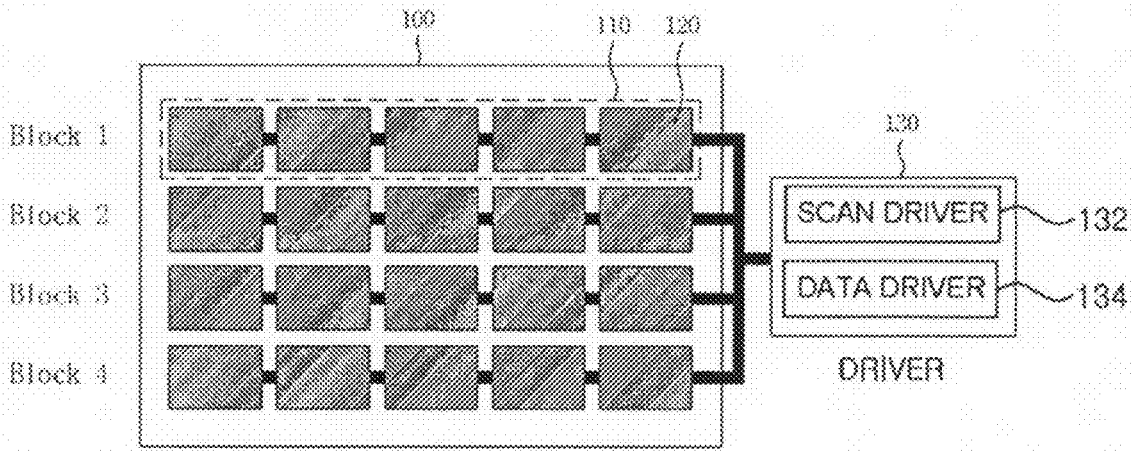
FIG. 1 illustrates a schematic diagram showing an light source apparatus according to an example embodiment of the present invention.

FIG. 1 illustrates a schematic diagram showing a light source apparatus according to an example embodiment of the present invention. Referring to FIG. 1, the light source apparatus 100 includes a plurality of cell units 110. The cell unit (or cell block) 110 includes a plurality of electricalicy connected organic light emitting panels 120. Although not shown, the organic light emitting panel 120 includes a plurality of sub-pixels.

Figure 2:
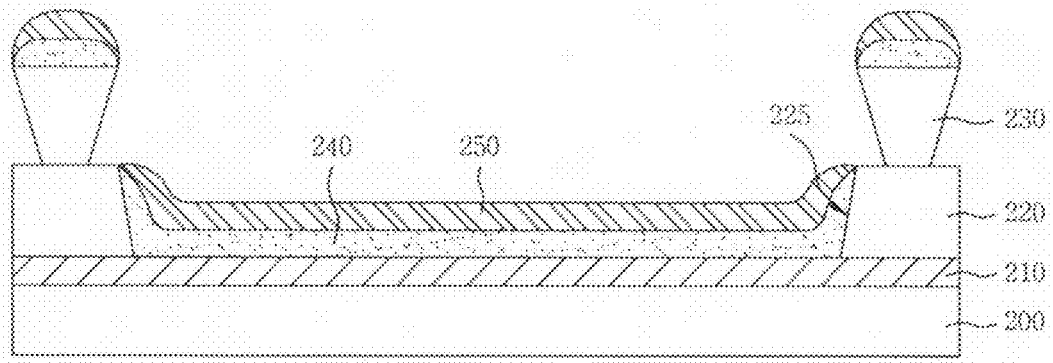
FIG. 2 illustrate a cross-sectional diagram showing a sub-pixel of the light source apparatus according to an example embodiment of the present invention.

FIG. 2 illustrates a cross-sectional diagram showing a sub-pixel of the light source apparatus according to an example embodiment of the present invention. Referring to FIG. 2, the sub-pixel includes a substrate 200 and a first electrode disposed on the substrate 200. The substrate may include glass, plastic material, or metal. The first electrode may include transparent conductive material such as Indium Tin Oxide. The first electrode may be an anode having a high value of work function. An insulation layer 220 is formed on the first electrode 210 and includes an opening 225 for exposing a portion of the first electrode 210. A barrier rib 230 having a reverse tapered shape is disposed on the insulation layer 220. An emission layer 240 is disposed on inner surface of the opening 225.

The emission layer 240 may include orgarnic material. Although not shown, a hole injection layer and/or a hole transport layer may be disposed between the first electrode 210 and the emission layer 240, an electron injection layer and/or an electron transport layer may be disposed on the emission layer 240.

A second electrode 250 is disposed on the emission layer 240. The second electrode 250 may include metal having low value of work function such as Magnesium and Aluminum, etc. The second electrode 250 may be patterned by the barrier rib 230 having the reverse tapered shape.

Although not shown, a thin film transistor, which is electrically connected to the first electrode 210, may be disposed on the substrate 200.

Each of the cell units 110 including the organic light emitting panel 120 having the sub-pixels is coupled to a driver 130. The driver 130 includes a scan driver 132 and a data driver 134. The scan driver 132 applies a plurality of scan signals to the respective cell units 110, and the data driver 134 applies a plurality of data signals to the respective cell units 110. A plurality of cell units including a plurality of sub-pixels is located in a matrix type format at intersections between the scan lines and the data lines on the substrate 200.

The data signal is supplied to an anode of the organic light emitting panel 130 of the respective cell unit 110, and the scan signal is supplied to a cathod of the organic light emitting panel 130 of the respective cell unit 110.

The anode that received the data signal supplies holes to the emission layer, and the holes supplied from the anode and the electrons supplied from the cathod recombines at the emission layer so that light is generated.

Since the organic light emitting panels 130 disposed at the same cell unit 110 are electrically connected to each other, the organic light emitting panels 130 disposed at the same cell unit 110 receive the same driving signal to emit light.

The data driver 134 supplies the data signal to the cell blocks 110 such that a summation of brightness values of all cell blocks 110 per a frame remains constant during a predetermined number of frame periods and at least one cell block among all cell blocks has a different brightness value from that of another cell block among all cell blocks during respective frame period.

FIG. 3 illustrates a schematic diagram showing a method of driving the light source apparatus according to an example embodiment of the present invention. FIG. 3 shows the cell blocks of the light source apparatus 100 according to an example embodiment of the present invention. The brightness is denoted as percent (%), and it is assumed that the maximum brightness of the organic light emitting panel is 100%. A period is comprised of a predetermined number of frames. In FIG. 3, one period is comprised of four frames.

Referring to FIG. 3, the summation of brightness values of all cell blocks 110 per a frame has a constant value of 320%. Since the light source apparatus according to an example embodiment of the present invention is used as a backlight unit or an illumination apparatus, and the light source apparatus emits light having the constant brightness during a predetermined number of frame periods.

In addition, the brightness values of the cell blocks 1, 2, 3 and 4 during the first frame may be respectively 50%, 70%, 100%, and 100%. As shown in FIG. 3, at least one cell block among the cell blocks 1, 2, 3 and 4 has a different brightness value from that of another cell block among the cell blocks 1, 2, 3 and 4 during respective frame.

And, the data signal supplied to the cell block 1 of a second frame may be supplied to the cell block 2 of a third frame, the data signal supplied to the cell block 2 of the second frame may be supplied to the cell block 3 of the third frame, the data signal supplied to the cell block 3 of the second frame may be supplied to the cell block 4 of the third frame. Namely, a data signal supplied to an (n)th cell block of a present frame—i.e. (K)th frame—may be sequentially applied to an (n+1)th cell block of a next frame—i.e. (K+1)th frame.

Since the data signals is sequentially supplied to the cell blocks during one period according the above descrived method, when the predetermined number of the frame periods is the same as a number of the cell blocks, a summation of the brightness of a cell block during one period is the same as a summation of the brightness of all cell blocks of a frame.

The magnitude of the data signals applied to the cell blocks during a frame gradually increases or gradually decreases. In addition, the magnitude of the data signals applied to a cell block during one period gradually increases or gradually decreases. Thus, the brightness of each of the cell blocks may be gradually increase or gradually decreases, but the user is not able to recognize that the variation of the brightness of the cell blocks in spite of the variation of the brightness of the cell blocks since the brightness of the whole light source apparatus is maintained constant.

Therefore, the light source apparatus according to an example embodiment of the present invention may provide light having constant brightness since the brightness of the cell blocks of a frame remains constant. In addition, the deterioration of the light source apparatus may be reduced because the organic light emitting panels of each of the cell blocks do not continuously emit light having high brightness but the quantity of the light is regulated periodically. Therefore, the light source apparatus according to an example embodiment of the present invention may provide light having uniform brightness and the lifespan of the light source apparatus may be increased.

Although above example embodiment described that the data signal supplied to an (n)th cell block of a present frame—i.e. (K)th frame—is sequentially applied to an (n+1)th cell block of a next frame—i.e. (K+1)th frame, the data signal may be supplied in a different way.

Namely, Referring to FIG. 4, the data signal supplied to the cell block 1(2, 3, 4) of the first frame may not be supplied to the cell block 2 (3, 4, 1) of the second frame, but may be randomly supplied to a cell block of the second frame. In the same way, the data signal supplied to the cell block 2 (3, 4, 1) of the second frame may not be supplied to the cell block 3 (4, 1, 2) of the third frame, but may be randomly supplied to a cell block of the third frame. In the same way, the data signal supplied to the cell block 4 (1, 2, 3) of the third frame may not be supplied to the cell block 1 (1, 2, 3) of the forut frame, but may be randomly supplied to a cell block of the fourth frame.

In addition, referring to FIG. 5, when the brightness of the cell blocks 1, 2, 3 and 4 per a frame remains constant, the data signal applied to the cell blocks 1, 2, 3 and 4 during a frist period (period 1) may be different from the data signal applied to the cell blocks 1, 2, 3 and 4 during a second period (period 2).

For example, Referring to FIG. 5, the summation of the brightness values of the cell blocks per a frame during the period 1 and the period 2 is 320%, the quantity of the data signals applied to the cell blocks per a frame during the period 1 and the period 2 may be different.

Namely, as shown in FIG. 5, the quantity of the data signals applied to the four cell blocks 1, 2, 3 and 4 per every frame during the period 1 is 50%, 70%, 100% and 100%, the quantity of the data signals applied to the four cell blocks 1, 2, 3 and 4 per every frame during the period 2 is 60%, 70%, 90% and 100%. Namely, when the summation of the brightness per a frame, the quantity of the data signals may be varied so as to prevent of the deterioration of the organic light emitting panel.

Alternatively, the summation of the brightness values of the cell blocks per a frame during the period 1 may be different from the summation of the brightness values of the cell blocks per a frame during the period 2.

For example, in case of illumination apparatus, the user selectively chooses the brightness of the illumination apparatus. Thus, when the summation of the brightness values of the cell blocks per a frame during a first period is 320%, the summation of the brightness values of the cell blocks per a frame during a second period may be 280% while the summation of the brightness of per each of the frames in one period is constant. In this case, the first period may be repeated several times, and the second period may be repeated several times.

Although the light source apparatus of the above example embodiments is comprised of a plurality of organic light emitting panels, the light source apparatus may be comporised of one large size of organic light emitting panel. When the light source apparatus is comprised of one large size of organic light emitting panel, the organic light emitting panel may be divided into a plurality of cell blocks, and the driver may drives each of the cell blocks.

What is claimed is:

1. A method of driving a light source apparatus including a plurality of cell blocks, comprising:

supplying a scan signal to the cell blocks respectively having at least one sub-pixel; and supplying a data signal to the cell blocks such that a summation of brightness values of the cell blocks per a frame remains constant during a period and at least one cell block among the cell blocks has a different brightness value from that of another cell block among the cell blocks during respective frame, wherein the period is comprised a predetermined number of frame.

2. The driving method of claim 1, wherein the period is comprised of all frames.

3. The driving method of claim 1, wherein a data signal applied to a first cell block during an (K)th frame is applied to a second cell block during an (K+1)th frame, wherein K is a natural number, and the second cell block is different from the first cell block.

4. The driving method of claim 1, wherein a data signal applied to an (n−1)th cell block during an K(th) frame is applied to an (n)th cell block during an (K+1)th frame, wherein K is a natural number.

5. The driving method of claim 1, wherein a magnitude of the data signal applied to the cell blocks during a frame gradually increases or gradually decreases.

6. The driving method of claim 1, wherein, when the predetermined number of frames is the same as a number of the cell blocks, a summation of the brightness of one cell block during the predetermined number of frame is the same as a summation of the brightness of cell blocks of one frame.

7. The driving method of claim 1, wherein first data signals supplied to the cell blocks during a first period are different from second data signals supplied to the cell blocks during a second period, and a summation of the brightness of one cell block during the first period is the same as a summation of the brightness of one cell block during the second period.

8. The driving method of claim 1, wherein first data signals supplied to the cell blocks during a first period are different from second data signals supplied to the cell blocks during a second period, and a summation of the brightness of one cell block during the first period is different from a summation of the brightness of one cell block during the second period.

9. The driving method of claim 1, wherein the sub-pixel comprises a first electrode, a second electrode and an emission layer disposed between the first and second electrodes.

10. A light source apparatus comprising:

a substrate;

a plurality of cell blocks including a plurality of sub-pixels located in a matrix type format at intersections between a plurality of scan lines and a plurality of data lines on the substrate;

a scan driver supplying a plurality of scan signals to the cell blocks through the scan lines;

a data driver supplying a plurality of data signals to the cell blocks such that a summation of brightness values of the cell blocks per a frame remains constant during a period and at least one cell block among the cell blocks has a different brightness value from that of another cell block among the cell blocks during respective frame, wherein the period is comprised a predetermined number of frame.

11. The light source apparatus of claim 10, the period is comprised of all frames.

12. The light source apparatus of claim 10, wherein, when the predetermined number of frames is the same as a number of the cell blocks, a summation of the brightness of one cell block during the predetermined number of frame is the same as a summation of the brightness of cell blocks of one frame.

13. The light source apparatus of claim 10, wherein first data signals supplied to the cell blocks during a first period are different from second data signals supplied to the cell blocks during a second period, and a summation of the brightness of one cell block during the first period is the same as a summation of the brightness of one cell block during the second period.

14. The light source apparatus of claim 10, wherein the sub-pixel comprises a first electrode, a second electrode and an emission layer disposed between the first and second electrodes.

15. The light source apparatus of claim 10, the light source apparatus includes at least one organic light emitting panel.

16. The light source apparatus of claim 10, wherein each of the cell blocks includes at least one organic light emitting panel.

* * * * *